US007331847B2

(12) United States Patent
Chen et al.

(10) Patent No.: US 7,331,847 B2
(45) Date of Patent: Feb. 19, 2008

(54) VIBRATION DAMPING IN CHEMICAL MECHANICAL POLISHING SYSTEM

(75) Inventors: Hung Chih Chen, San Jose, CA (US); John M. White, Hayward, CA (US); Shijian Li, San Jose, CA (US); Fred C. Redeker, Fremont, CA (US); Ramin Emami, San Jose, CA (US)

(73) Assignee: Applied Materials, Inc, Santa Clara, CA (US)

( * ) Notice: Subject to any disclaimer, the term of this patent is extended or adjusted under 35 U.S.C. 154(b) by 0 days.

(21) Appl. No.: 11/333,992

(22) Filed: Jan. 17, 2006

(65) Prior Publication Data

US 2006/0148387 A1 Jul. 6, 2006

Related U.S. Application Data

(62) Division of application No. 10/754,997, filed on Jan. 10, 2004, now Pat. No. 7,014,545, which is a division of application No. 09/658,417, filed on Sep. 8, 2000, now Pat. No. 6,676,497.

(51) Int. Cl.
*B24B 7/00* (2006.01)
*B24B 9/00* (2006.01)

(52) U.S. Cl. ..... 451/285; 451/288; 451/533; 451/550

(58) Field of Classification Search ..... 451/285, 451/286, 287, 288, 289, 290, 533, 550
See application file for complete search history.

(56) References Cited

U.S. PATENT DOCUMENTS 3,504,457 A * 4/1970 Jacobsen et al. ..... 451/288
3,747,282 A 7/1973 Katzke
3,833,230 A 9/1974 Noll
4,141,180 A 2/1979 Gill et al.
4,193,226 A 3/1980 Gill et al.
4,217,766 A 8/1980 Suckow (Continued)

FOREIGN PATENT DOCUMENTS

EP 0 156 746 A1 10/1985

(Continued)

OTHER PUBLICATIONS

B. Holley and E. Mendel, "Mounting Method for Single-Side Polishing", Mar. 1979, IBM Technical Disclsosure Bulletin, vol. 21, No. 10.

(Continued)

*Primary Examiner*—Timothy V. Eley
(74) *Attorney, Agent, or Firm*—Fish & Richardson

(57) ABSTRACT

A carrier head for chemical mechanical polishing, includes a base, a support structure attached to the base having a surface for contacting a substrate, and a retaining structure attached to the base to prevent the substrate from moving along the surface. The retaining structure and the surface define a cavity for receiving the substrate. A polishing station includes a platen, a vibration damper mounted on the platen and a substrate polishing pad mounted on the vibration damper. The vibration damper includes a material that does not rebound to its original shape when subjected to a deformation.

6 Claims, 3 Drawing Sheets

U.S. PATENT DOCUMENTS

| | | | | |
|---|---|---|---|---|
| 4,373,991 | A | 2/1983 | Banks | |
| 4,519,168 | A | 5/1985 | Cesna | |
| 4,905,772 | A | 3/1990 | Honsa et al. | |
| 4,954,142 | A | 9/1990 | Carr et al. | |
| 5,081,795 | A | 1/1992 | Tanaka et al. | |
| 5,205,082 | A | 4/1993 | Shendon et al. | |
| 5,230,184 | A | 7/1993 | Bukham | |
| 5,423,558 | A | 6/1995 | Koeth et al. | |
| 5,423,716 | A | 6/1995 | Strasbaugh | |
| 5,441,444 | A | 8/1995 | Nakajima | |
| 5,443,416 | A | 8/1995 | Volodarsky | |
| 5,449,316 | A | 9/1995 | Strasbaugh | |
| 5,584,746 | A | 12/1996 | Tanaka et al. | |
| 5,584,751 | A | 12/1996 | Kobayashi et al. | |
| 5,605,488 | A | 2/1997 | Ohashi et al. | |
| 5,624,299 | A | 4/1997 | Shendon | |
| 5,635,083 | A | 6/1997 | Breivogel et al. | |
| 5,643,061 | A | 7/1997 | Jackson et al. | |
| 5,645,474 | A | 7/1997 | Kubo et al. | |
| 5,664,988 | A | 9/1997 | Stroupe et al. | |
| 5,679,064 | A | 10/1997 | Nishi et al. | |
| 5,695,392 | A | 12/1997 | Kim | |
| 5,716,264 | A | 2/1998 | Kimura et al. | |
| 5,733,182 | A | 3/1998 | Muramatsu et al. | |
| 5,738,568 | A | 4/1998 | Jurjevic et al. | |
| 5,740,893 | A | 4/1998 | Yamamoto | |
| 5,759,918 | A | 6/1998 | Hoshizaki et al. | |
| 5,795,215 | A | 8/1998 | Guthrie et al. | |
| 5,820,448 | A | 10/1998 | Shamouilian et al. | |
| 5,851,140 | A | 12/1998 | Barns et al. | |
| 5,899,798 | A | 5/1999 | Trojan et al. | |
| 5,908,530 | A | 6/1999 | Hoshizaki et al. | |
| 5,916,015 | A | 6/1999 | Natalicio | |
| 5,916,412 | A | 6/1999 | Nakashiba et al. | |
| 5,916,954 | A | 6/1999 | Bohn et al. | |
| 5,944,590 | A | 8/1999 | Isobe et al. | |
| 5,993,302 | A | 11/1999 | Chen et al. | |
| 6,007,252 | A | 12/1999 | Thelen et al. | |
| 6,019,670 | A | 2/2000 | Cheng et al. | |
| 6,036,587 | A | 3/2000 | Tolles et al. | |
| 6,044,818 | A | 4/2000 | Decuir | |
| 6,068,548 | A | 5/2000 | Vote et al. | |
| 6,077,385 | A | 6/2000 | Kimura et al. | |
| 6,102,777 | A | 8/2000 | Duescher et al. | |
| 6,113,479 | A | 9/2000 | Sinclair et al. | |
| 6,121,142 | A | 9/2000 | Crevasse et al. | |
| 6,183,354 | B1 | 2/2001 | Zuniga et al. | |
| 6,190,238 | B1 | 2/2001 | Tanaka et al. | |
| 6,196,904 | B1 | 3/2001 | Matsuo et al. | |
| 6,251,215 | B1 | 6/2001 | Zuniga et al. | |
| 6,261,958 | B1 * | 7/2001 | Crevasse et al. | 438/692 |
| 6,273,803 | B1 | 8/2001 | Wang et al. | |
| 6,277,008 | B1 | 8/2001 | Masuta et al. | |
| 6,306,021 | B1 * | 10/2001 | Masumura et al. | 451/287 |
| 6,390,904 | B1 | 5/2002 | Gleason et al. | |
| 6,447,368 | B1 | 9/2002 | Fruitman et al. | |
| 6,627,098 | B2 | 9/2003 | Custer et al. | |
| 6,666,756 | B1 | 12/2003 | Travis | |
| 2001/0031612 | A1 * | 10/2001 | Scott et al. | 451/65 |
| 2002/0004357 | A1 * | 1/2002 | Baker et al. | 451/41 |
| 2002/0081946 | A1 * | 6/2002 | Scott et al. | 451/36 |
| 2005/0020082 | A1 * | 1/2005 | Vishwanathan et al. | 438/690 |
| 2006/0118525 | A1 * | 6/2006 | Ward | 216/89 |

FOREIGN PATENT DOCUMENTS

| | | |
|---|---|---|
| EP | 0 474 167 A2 | 12/1996 |
| EP | 0 776 730 | 6/1997 |
| EP | 0 790 100 A1 | 8/1997 |
| EP | 0 841 123 A1 | 5/1998 |
| EP | 0 988 931 | 3/2000 |
| GB | 2 307 342 A | 5/1997 |
| GB | 2 336 121 | 10/1999 |
| JP | 61-25768 | 2/1986 |
| JP | 62-145830 | 6/1987 |
| JP | 2-243263 | 9/1990 |
| JP | 6-039705 | 2/1994 |
| JP | 10-034530 | 2/1998 |
| JP | 11-291162 | 10/1999 |
| WO | WO 99/62672 | 12/1999 |

OTHER PUBLICATIONS

"Advanced Engineering Plastics for the Semiconductor Industry", DSM Engineering Plastic Products (Polymer Corporation) product information bulletin, © 1996.

"Advanced Engineering Plastics for the Semiconductor Industry", DSM Engineering Plastic Products (Polymer Corporation) product information bulletin, © 1997.

Sanford, "High-Performance Resins Take Charge and More", *Machine Design*, pp. 52-56, 1996.

* cited by examiner

VIBRATION DAMPING IN CHEMICAL MECHANICAL POLISHING SYSTEM

CROSS REFERENCE AND RELATED APPLICATIONS

This application is a divisional of U.S. patent application Ser. No. 10/754,997 filed Jan. 10, 2004 now U.S. Pat. No. 7,014,545, entitled "VIBRATION DAMPING IN A CHEMICAL MECHANICAL POLISHING SYSTEM", which is a divisional of U.S. patent application Ser. No. 09/658,417 filed Sep. 8, 2000, entitled "VIBRATION DAMPING IN A CHEMICAL MECHANICAL POLISHING SYSTEM" now issued as U.S. Pat. No. 6,676,497, both of which are incorporated herein by reference in their entirety. This application is also related to pending U.S. patent application Ser. No. 09/975,196, filed Oct. 10, 2001, entitled "CARRIER HEAD WITH VIBRATION DAMPING", pending U.S. patent application Ser. No. 11/046,189, filed Jan. 28, 2005, entitled "VIBRATION DAMPING DURING CHEMICAL MECHANICAL POLISHING", and U.S. patent application Ser. No. 10/124,066, filed Apr. 16, 2002, entitled "VIBRATION DAMPING IN A CARRIER HEAD", now issued as U.S. Pat. No. 6,848,980.

TECHNICAL FIELD

This invention relates generally to chemical mechanical polishing systems and processes.

BACKGROUND

Integrated circuits are typically formed on substrates, particularly silicon wafers, by the sequential deposition of conductive, semiconductive or insulative layers. After a layer is deposited, a photoresist coating is applied on top of the layer. A photolithographic apparatus, which operates by focusing a light image on the coating, is used to remove predetermined portions of the coating, leaving the photoresist coating on areas where circuitry features are to be formed. The substrate is then etched to remove the uncoated portions of the layer, leaving the desired circuitry features.

As a series of layers are sequentially deposited and etched, the outer or uppermost surface of the substrate, becomes increasingly non-planar. This non-planar surface presents problems in the photolithographic steps of the integrated circuit fabrication process. Specifically, the photolithographic apparatus may not be able to focus the light image on the photoresist layer if the maximum height difference between the peaks and valleys of the non-planar surface exceeds the depth of focus of the apparatus. Therefore, there is a need to periodically planarize the substrate surface.

Chemical mechanical polishing (CMP) is one accepted method of planarization. Chemical mechanical polishing typically requires mechanically abrading the substrate in a slurry that contains a chemically reactive agent. During polishing, the substrate is typically held against a rotating polishing pad by a carrier head. The carrier head may also rotate and move the substrate relative to the polishing pad. As a result of the motion between the carrier head and the polishing pad, abrasives, which may either be embedded in the polishing pad or contained in the polishing slurry, planarize the non-planar substrate surface by abrading the surface.

The polishing process generates vibrations that may reduce the quality of the planarization or damage the polishing apparatus.

SUMMARY

In general, one aspect of the invention relates to a carrier head for chemical mechanical polishing. The carrier head has a base, a support structure attached to the base, and a retaining structure attached to the base. The support structure has a surface for contacting a substrate while the retaining structure prevents the substrate from moving along the surface. The retaining structure and the surface define a cavity for receiving the substrate. The retaining structure includes an upper portion in contact with the base, a lower portion, and a vibration damper separating the upper portion and the lower portion. The vibration damper includes a material that does not rebound to its original shape when subjected to a deformation.

In general, a second aspect of the invention relates to a chemical mechanical polishing apparatus that includes a polishing pad to polish a substrate and the carrier ahead described above.

Implementations of the first and second aspects of the invention may include one or more of the following features. The lower portion of the retaining structure may be thicker than the substrate to prevent the vibration damper and the upper portion from contacting the substrate. The lower portion of the retaining structure may define the walls of the cavity for receiving the substrate, and the vibration damper may reduce the transmission of vibration energy from the substrate through the lower portion to the upper portion. The lower portion may contact a polishing pad during polishing, while the vibration damper may reduce the transmission of vibration energy from the polishing pad through the lower portion to the upper portion. The retaining structure may be an annular wall around a periphery of the surface, and the vibration damper may be an annular ring separating the annular upper portion from the annular lower portion. The vibration damper may be mounted on the first portion and the second portion using a pressure sensitive adhesive. The lower portion may include a wearable member for contacting the polishing pad, and a support member may be mounted on the wearable member to add rigidity to the wearable member. The vibration damper may be mounted on the support member.

In general, a third aspect of the invention relates to a polishing station that includes a platen, a vibration damper mounted on the platen, and a substrate polishing pad mounted on the vibration damper. The vibration damper includes a material that does not rebound to its original shape when subjected to a deformation.

In general, a fourth aspect of the invention relates to a chemical mechanical polishing apparatus including the polishing station described above and a carrier head to press a substrate on the polishing pad when the substrate is being polished.

Implementations of the third and fourth aspect of the invention may include one or more of the following features. The vibration damper may be substantially disc shaped and may be mounted on the platen and the substrate polishing pad using a pressure sensitive adhesive. The polishing station may include a protective layer for mounting the polishing pad on the vibration damper. The protective layer may include a Teflon sheet, aluminum, or stainless steel, and the protective layer may be adhered to the vibration damper and the polishing pad using a pressure sensitive adhesive.

In general, a fifth aspect of the invention relates to a carrier head for positioning a substrate on a polishing surface. The carrier head includes a structure having a surface for contacting a substrate, a housing connectable to a drive shaft to rotate with the drive shaft about a rotation axis, and a gimbal mechanism between the structure and the housing to preventing the structure from moving out of the rotation axis. The gimbal mechanism prevents the structure from moving laterally while permitting the structure to gimbal relative to the housing. The gimbal has a top coupled to the housing, a bottom coupled to the structure, and a vibration damper separating the top from the bottom. The vibration damper includes a material that does not rebound to its original shape when subjected to a deformation.

In general, a sixth aspect of the invention relates to a chemical mechanical polishing apparatus that includes a polishing pad and the carrier head just described above.

Implementations of the fifth and sixth aspect of the invention may include one or more of the following features. The vibration damper may be mounted to the top and the bottom using a pressure sensitive adhesive. The housing may define a bushing, and the top may include a gimbal rod that extends into the bushing to couple the top to the housing, and a gimbal ring that is coupled to the gimbal rod. The bushing may allows the gimbal rod to move along the rotation axis while preventing the gimbal rod from moving out of the rotation axis. The vibration damper may be mounted on the gimbal ring using a pressure sensitive adhesive. The gimbal mechanism may include a substantially planar flexure ring that flexes in a direction perpendicular to the plane of the flexure ring to gimbal the structure to the housing. The damping material may be mounted on the flexure ring using a pressure sensitive adhesive.

Implementations of all the general aspects of the invention may include one or more of the following features. The damping material may rebound by less than ten percent of the deformation, preferably less than six percent of the deformation. The damping material may include a soft plastic or a visco-elastomer, such as an isodamp C-1000 series isolation damping material (e.g. C-1002 material).

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
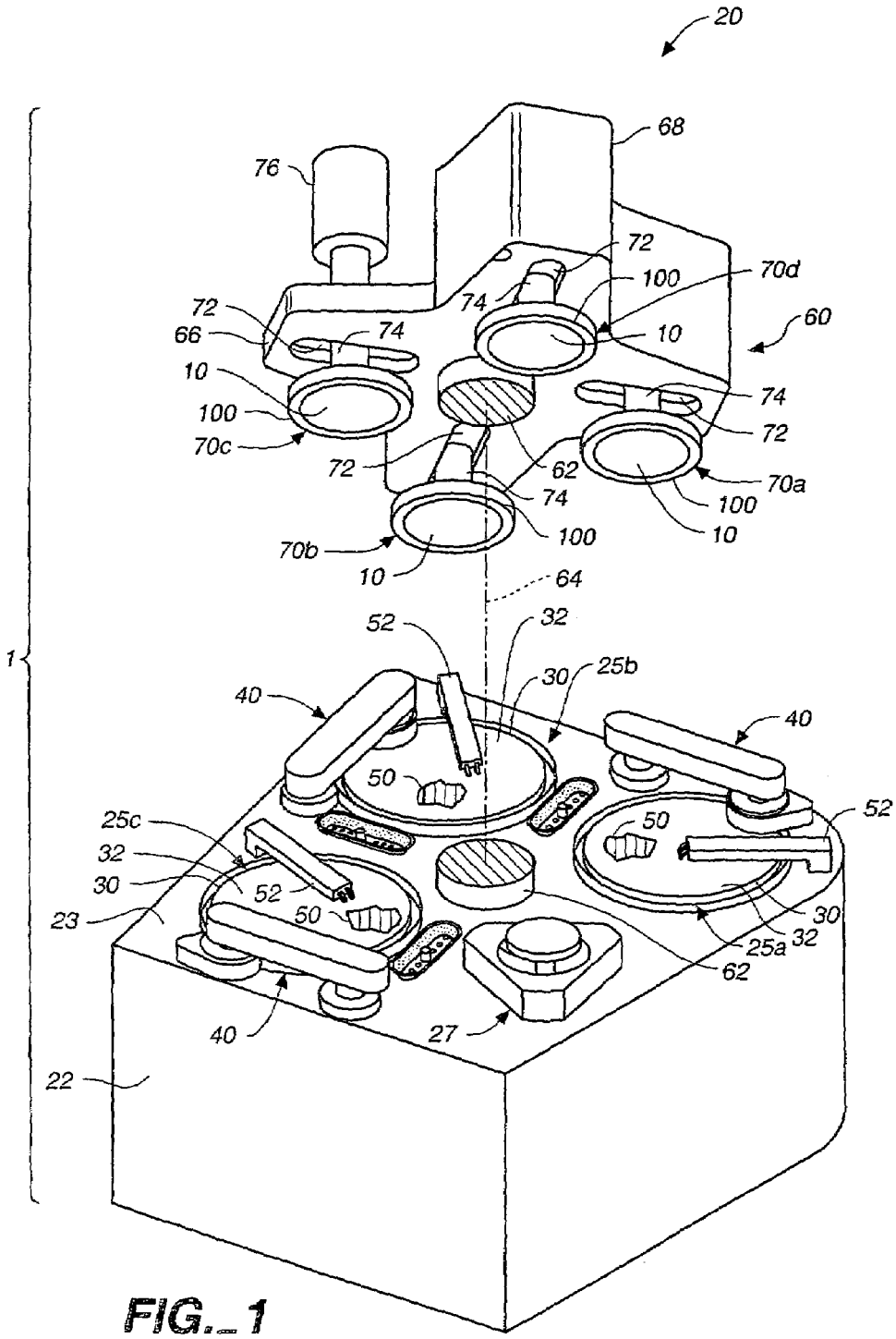
FIG. 1 shows a polishing machine having three polishing stations and four carrier heads.

Referring to FIG. 1, a chemical mechanical polishing (CMP) apparatus 1 embodying the invention will be described. The CMP apparatus 1 is used for polishing a substrate 10. A more detailed description of a similar CMP apparatus may be found in U.S. Pat. No. 5,738,574, the entire disclosure of which is hereby incorporated by reference.

The CMP apparatus 1 includes a lower machine base 22 and a multi-head carousel 60. The lower machine base 22 has three polishing stations 25*a*, 25*b*, and 25*c* on a tabletop 23. Each polishing station 25*a*-25*c* includes a circular polishing pad 32, which is adhered to a circular platen 30, of about the same diameter as the polishing pad 32, using a pressure sensitive adhesive (PSA) (not shown). Platen 30 is a stainless steel plate connected by a stainless steel platen drive shaft (not shown) to a platen drive motor (also not shown), which is located inside machine base 22. The polishing pad 32 is a fixed abrasive polishing pad, manufactured by 3M Superabrasives and Microfinishing Systems Division, St.Paul, Minn., Tel. (651) 737-1785. The fixed-abrasive polishing pad 32 contains abrasive particles, such as silica, embedded in a resin. The resin slowly disintegrates during use revealing new abrasive particles for polishing. Because the apparatus 1 is used for polishing "eight-inch" or "twelve-inch" substrates, the diameter of the polishing pad 32 and the platen 30 is between twenty and thirty inches.

A slurry arm 52 provides slurry to the polishing pad 32 through several spray nozzles (not shown). The slurry contains a reactive agent and a chemically reactive catalyzer. To polish an oxide substrate, deionized water is used as the reactive agent and potassium hydroxide is used as the catalyzer. The slurry arm 52 also provides fluid for rinsing the substrate.

The carousel 60 is positioned above the lower machine base 22. Carousel 60 includes four carrier head systems 70*a*-70*d* that are spaced at equal angular intervals about an axis 64 of symmetry of the carousel. Each carrier head system 70*a*-70*d* has a circular carrier head 100 for holding a substrate 10. The carrier head 100 is mounted on a drive shaft 74, which extends through a slot 72 to connect the carrier head to a carrier head rotation motor 76. The carrier head rotation motor 76 is supported on a slider (not shown).

During polishing, a pneumatic system (described below) lowers the carrier head 100 onto a polishing pad 32 to press the substrate 10 against the polishing pad 32 with a predetermined loading force. The platen drive motor rotates the platen, thereby causing the polishing pad 32 to rotate. At the same time, the rotation motor 76 rotates the substrate 10 by rotating the carrier head 100, while the slider (not shown) linearly drives the rotation motor 76 back and forth along the slot 72 to oscillate the carrier head 100 and the substrate 10 laterally on the surface of the polishing pad. Thus the apparatus moves the substrate 10 relative to the polishing pad 32, thereby abrading the surface of the substrate against abrasives contained within the polishing pad. The slurry arm 52 provides slurry 50, which contains a reactive agent (as previously described), to facilitate the polishing of the substrate. The loading and motion of the carrier head against the polishing pad, and the rotation speed of the polishing pad are carefully controlled to maintain a desired rate and quality of polishing.

We will describe three embodiments of the polishing apparatus 10 according to the invention. The embodiments use a vibration damping material at different locations to significantly reduce the transfer of vibrational energy from one part of the polishing apparatus adjacent to the damping material to another adjacent part of the polishing system and thereby reducing or preventing vibration during polishing. Generally, the damping material has significantly better vibration damping characteristics than both adjacent parts of the polishing apparatus, which are typically made from stiff materials, e.g., metals. The damping material is a visco-elastomer with little or no memory so as to provide good vibration damping characteristics, such as the commercially available, isolation damping material, C-1002, which is manufactured by E-A-R specialty composites of 7911 Zionesville Rd, Indianapolis, Ind. 46268.

Figure 2:
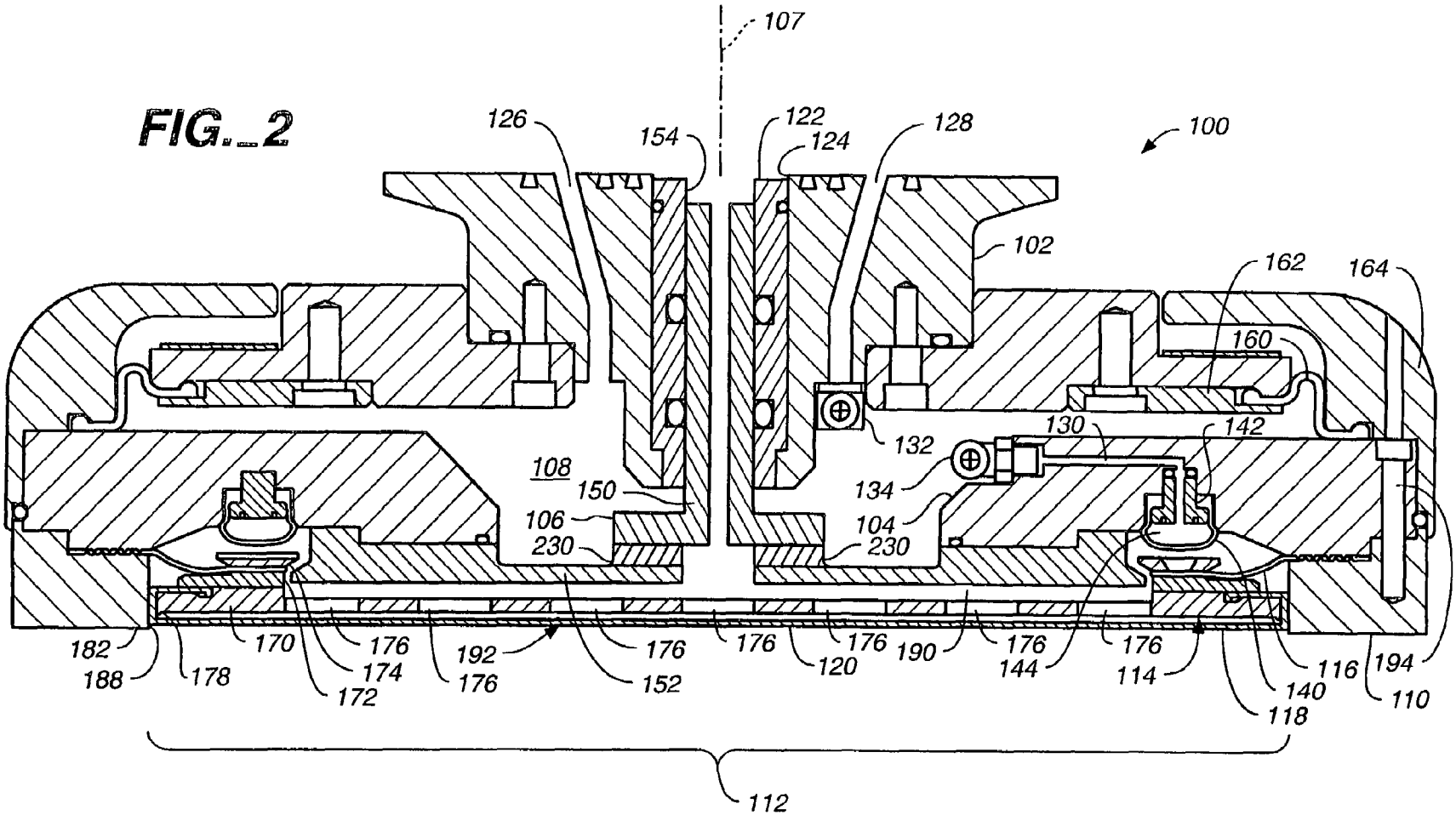
FIG. 2 is a cross-sectional view of a carrier head of FIG. 1, which includes a retaining ring.

Referring to FIG. 2, a first embodiment that has the vibration damping material in the carrier head 100 will be described. Carrier head 100 includes a housing 102, a base 104, a gimbal mechanism 106, a retaining ring 110, and a substrate backing assembly 112. The housing 102 is substantially cylindrical and can be connected to a drive shaft 74 using a set of bolts (not shown). The drive shaft rotates the housing about an axis 107. A passage 126 extends through the housing for pneumatic control of the carrier head, as will be described below. The housing 102 has a cylindrical bushing 122 fitted into a vertical bore 124, which, runs vertically through the housing.

Gimbal mechanism 106 has a gimbal rod 150, which is fitted into the bushing 122 so that the rod 150 is free to move vertically within the bore. The bushing 122 prevents lateral motion of the gimbal rod 150. A gimbal ring 220 is attached to the gimbal rod 150. A flexure ring 152 is attached to the gimbal ring 220 through a damping material 230, to prevent or reduce the transmission of vibration energy from the flexure ring 152 to the housing 102, through the gimbal ring 220. The damping material 230 is 0.06 inches thick. Pressure sensitive adhesive (not shown) adheres the damping material 230 to both the gimbal ring 220 and the flexure ring 152.

The flexure ring 152, which is a generally planar annular ring, is attached to the generally ring-shaped base 104. The flexure ring 152 flexes in a direction perpendicular to the plane of the flexure ring 152, thereby gimballing the base 104 to the gimbal rod 150 and the housing 102. The gimbal mechanism also allows the base 104 to move up and down by allowing the gimbal rod 150 to move vertically within the bore 122, while preventing any lateral motion of the base. The damping material 230 reduces or prevents the transmission of vibrational energy from the base 104 into the housing 102 through the gimbal mechanism 106.

An outer clamp ring 164, which is bolted onto the base 104 by a bolt 194, clamps a rolling diaphragm 160 to the base 104. Rolling diaphragm 160 may be a generally ring shaped sixty mil thick silicone sheet. An inner clamp ring 162, which is bolted onto the housing 102 by bolts 240, clamps the rolling diaphragm 160 onto the housing. Thus, the rolling diaphragm 160 seals the loading chamber 108 formed by the housing 102, the gimbal rod 106, the gimbal ring 220, the damping material 230, the flexure ring 152, and the base 104, leaving an opening 126 into the chamber 108. The opening 126 is connected to a pump (not shown), which lowers or raises the base by pumping fluid, e.g., air, into or out of the chamber 108, respectively. By controlling the pressure of the fluid pumped into the loading chamber 108, the pump can press down the base towards the polishing surface with a desired loading force. The opening 126 is coupled to the pump by a coupling (also not shown), which allows the housing 102 to rotate, without interrupting the connection between the opening 126 and the pump.

The retaining ring 110 is a generally annular ring bolted onto the base 104 by bolts 194 (only one is shown in the cross-sectional view of FIG. 2). During polishing, fluid is pumped into the loading chamber 108, thereby generating pressure in the chamber 108. The generated pressure exerts a downward force on the base 104, which in turn exerts a downward force on the retaining ring 110. The downward force presses the retaining ring 110 against the polishing pad 32.

Substrate backing assembly 112 includes a flexure diaphragm 116, which is clamped between the retaining ring 110 and the base 104. The flexure diaphragm 116 is a generally planar annular ring, which is flexible and elastic in a direction perpendicular to the plane of the diaphragm 116. The flexure diaphragm 116 may be formed from rubber, such as neoprene, an elastomeric-coated fabric, such as NYLON™ or NOMEX™, plastic, or a composite material, such as fiberglass. An inner edge of the flexure diaphragm 116 is clamped between an annular lower clamp 172 and an annular upper clamp 174 of a support structure 114. A support plate 170 of the support structure 114 is attached to the lower clamp 172. The flexure diaphragm allows some vertical motion of the support plate 170 relative to the base 104. The support plate 170 is a generally disk-shaped rigid member with a plurality of apertures 176 through it (only one is labeled in FIG. 2). The support plate 170 has a downwardly projecting lip 178 at its outer edge.

A flexible membrane 118 extends around the lip 178 of the support plate 170 and is clamped between the support plate 170 and the lower clamp 172, to form a generally disk shaped lower surface 120. The flexible membrane is formed from a flexible and elastic material, such as chloroprene or ethylene propylene rubber. Alternatively, the flexure diaphragm and the flexible membrane can be combined in a single-piece membrane. The sealed volume between the flexible membrane 118, support structure 114, flexure diaphragm 116, base 104, and flexure ring 152 defines a chamber 190 whose only opening 250 runs through the gimbal rod 150. A pump (not shown) is connected to the opening 250 to control the pressure in the chamber 190 by pumping fluid, into the chamber through the opening 250, thereby controlling the downward pressure of the membrane lower surface 120 on the substrate 10.

An inner surface 188 of the retaining ring 110 in conjunction with the lower surface 120 of the flexible membrane 188 define a cavity 192 for receiving a substrate. The retaining ring keeps the substrate from slipping laterally out of the cavity 192, while the lower surface 120 of the flexible membrane 188 pushes the substrate, contained within the cavity 192, against the polishing pad 32 (FIG. 1).

Figure 3A:
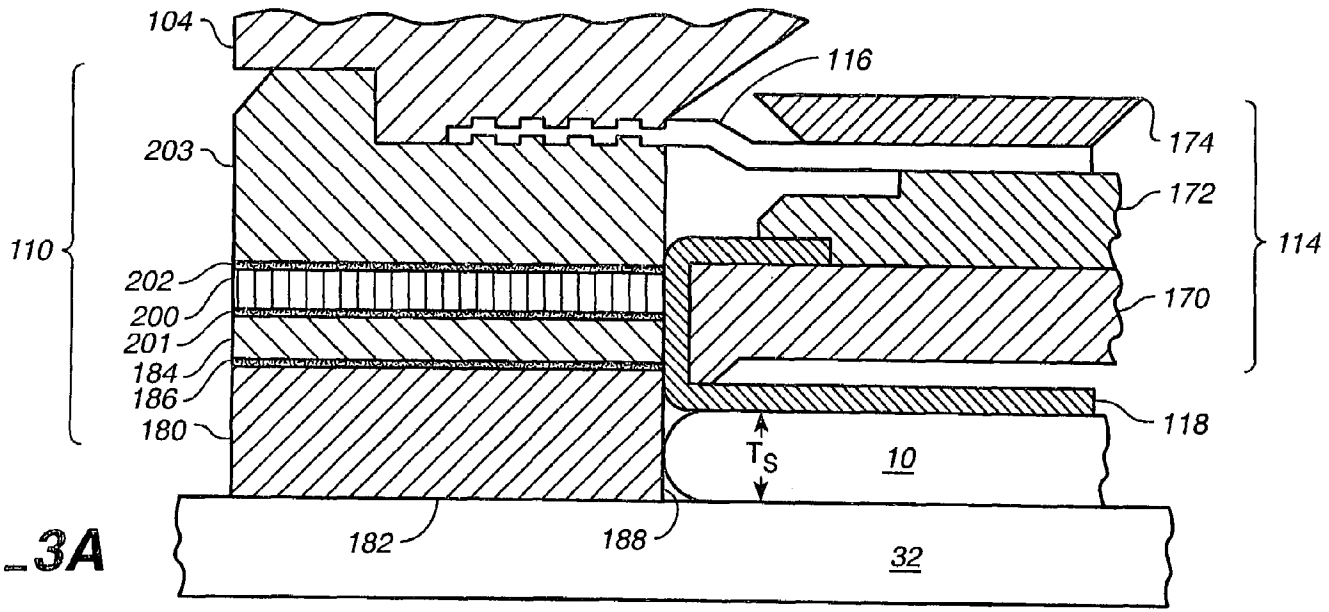
FIG. 3A is a more detailed cross-sectional view of the retaining ring of FIG. 2 during polishing.

A second embodiment of the invention includes the damping material in the retaining ring itself. Referring to FIG. 3A, the annular retaining ring 110 includes four portions, which are stacked one on top of another. The upper portion 203 of the retaining ring 110 is an annular steel ring with a thickness of about 0.1 inches, which is in contact with the base 104. The upper portion 203 is attached to a middle portion 184 through a damping material 200, which is similar in thickness and is made from the same material as the damping material 230 of FIG. 2. The damping material 200 reduces or prevents the transmission of vibration energy from the middle portion 184 to the upper portion 203. Pressure sensitive adhesive 202 adheres the damping material 200 to the upper portion 203, while pressure sensitive adhesive 201 adheres the damping material 200 to the middle portion 184.

The middle portion 184 is a quarter-inch thick stainless steel ring, which is adhered to a lower portion 180 by a layer of epoxy adhesive 186, specifically, Magnobond-6375™, available from Magnolia Plastics of Chamblee, Ga. The middle portion 184 adds rigidity to lower portion 180, thereby reducing the deformation of the retaining ring during polishing. The lower portion 180 is an annular ring formed from polyphenylene sulfide (PPS), available from DSM Engineering Plastics of Evansville, Ind., under the trade name Techtrom™. The lower portion 180 is durable but gradually wears away with use. Other plastics, such as DELRIN™, available from Dupont of Wilmington, Del., polyethylene terephthalate (PET), polyetheretherketone (PEEK), or a composite material such as XYMAXX™, also available from Dupont, may be used instead. The lower portion 180 has a bottom surface 182, which contacts the polishing pad 32 during polishing. The bottom surface has substantially radial grooves (not shown) for transporting slurry from the outside of the retaining ring to the surface of the substrate 10.

The thickness $T_L$ of the lower portion 180 should be larger than the thickness $T_S$ of the substrate 10. Specifically, the lower portion 180 should be thick enough that the substrate 10 does not contact the adhesive layer 186. On the other hand, if the lower portion 180 is too thick, the bottom surface 182 of the retaining ring 110 may be subject to deformation due to the flexible nature of the lower portion 180. The initial thickness of the lower portion is typically between 200 to 400 mils. The lower portion 180 is replaced when the remaining thickness of the retaining ring is about the same as the thickness of the substrate.

Figure 3B:
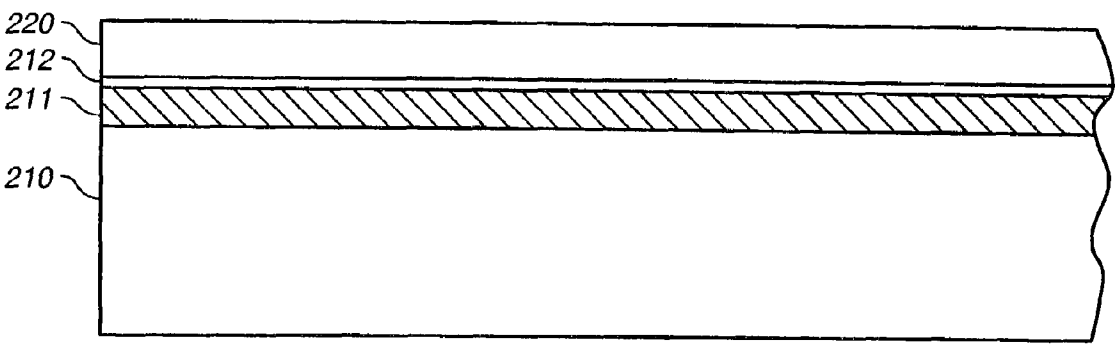
FIG. 3B is a cross-sectional view of the polishing station of FIG. 1.

Referring to FIG. 3B, a third alternate embodiment has a damping material 211 located between the polishing pad 235 and the platen 210 to reduce or prevent the transmission of vibration energy from the polishing pad 235 to the platen 210. The damping material 211 is similar in thickness and is made from the same material as the damping material 230 of FIG. 2. A pressure sensitive adhesive layer (not shown) adheres the damping material 211 to the polishing platen 210.

The damping material 211 is attached to the polishing pad 235 through a protective layer 212. The protective layer 212 is a 0.01-inch thick Teflon (i.e., polytetrafluoroethylene) sheet that makes it easier to detach the polishing pad 235 from the damping material 211. A layer of pressure sensitive adhesive (not shown) adheres the protective layer 212 to the damping material 211, while a second layer of pressure sensitive adhesive (not shown) adheres the protective layer 212 to the polishing pad 235.

A number of embodiments of the invention have been described. Nevertheless, it will be understood that various modifications may be made without departing from the spirit and scope of the invention. For example, the damping material may be used with other kinds of polishing apparatus known to persons skilled in the art. For instance, the retaining ring in the apparatus need not contact the polishing pad, as described in the specification. One of the polishing pad and the retaining ring of the polishing system may not rotate at all. The damping material may be used in a polishing apparatus that uses a standard non-abrasive polishing pad provided with a slurry that contains abrasives, such as silicon dioxide particles, in a chemically reactive agent, such as deionized water or potassium hydroxide.

The vibration damping material may also be used in any pair of the locations described in the specification, or even in all of the locations described. Other materials with suitable damping properties may be used to damp vibrations, so long as they significantly reduce or prevent the transmission of vibrational energy from one end of the material to another. Any material that does not rebound to its original shape when deformed may be used as a damping material. Specifically, when subjected to a deformation, the damping material should rebound by less then ten percent of the deformation, although a rebound of less than six percent of the deformation is preferred. For instance, the damping material may be any isodamp C-1000 series isolation damping material, manufactured by E-A-R specialty composites, a visco-elastomer, a soft-plastic, or any other material that has better vibration damping properties than materials immediately adjacent to the damping material.

The thickness of the damping material may be varied to provide optimum results in operating conditions that have different loading, carrier head rotation speed, polishing pad rotation speed, damping material, and so on. A thicker damping material may be used to improve the vibration damping, although poor control of the relative motion of the substrate and the polishing pad may result from a damping material that is too thick. A thinner damping material may also be used, although if the damping material is too thin, it may not sufficiently reduce or prevent the transmission of vibrational energy.

The middle portion 184 and the upper portion 203 (FIG. 3A) of the retaining ring maybe manufactured from aluminum or any other material that provides a suitable amount of stiffness to the retaining ring. The thickness of the middle portion 184 and the upper portion 203 may be varied, although if the middle and upper portions are too thin, the retaining ring may deform and reduce the quality of polishing. Alternatively, the middle portion 184 and the lower portion 180 (FIG. 3A) of the retaining ring 110 may be one integrated piece formed from the same kind of material, e.g., PPS or stainless steel. Other adhesive or attachment methods known to persons of skill may be used to affix the damping material.

Accordingly, other embodiments are within the scope of the following claims.

What is claimed is:

1. A polishing station, comprising:

a platen, a vibration damper adhered to the platen with an adhesive layer, the vibration damper including a material that does not rebound to its original shape when subjected to a deformation and reduces vibration energy transmitted from the polishing pad to the platen, a substrate polishing pad mounted on the vibration damper, and a protective layer for mounting the polishing pad on the vibration damper, wherein the protective layer includes a polytetrafluoroethylene sheet.

2. The apparatus of claim 1, wherein the vibration damper is substantially disc shaped.

3. The apparatus of claim 1, wherein the vibration damper is mounted on at least one of the platen and the substrate polishing pad using a pressure sensitive adhesive.

4. The apparatus of claim 1, wherein the protective layer is adhered to at least one of the vibration damper and the polishing pad using a pressure sensitive adhesive.

5. The apparatus of claim 1, wherein the material rebounds by less than five percent of the deformation.

6. A chemical mechanical polishing apparatus, comprising:

a polishing station, including:

a platen, a vibration damper adhered to the platen with an adhesive layer, and a substrate polishing pad mounted on the vibration damper, the vibration damper including a material that does not rebound to its original shape when subjected to a deformation and reduces vibration energy transmitted from the polishing pad to the platen;

a protective layer for mounting the polishing pad on the vibration damper, wherein the protective layer includes a polytetrafluoroethylene sheet; and a carrier head to press a substrate on the polishing pad when the substrate is being polished.

* * * * *